US007730730B2

(12) United States Patent
Ha et al.

(10) Patent No.: US 7,730,730 B2
(45) Date of Patent: Jun. 8, 2010

(54) CONTROL METHOD OF AN AIR CONDITIONER INDOOR UNIT

(75) Inventors: Do Yong Ha, Anyang-si (KR); Ho Jong Jeong, Seoul (KR); Ki Bum Kim, Seoul (KR); Jin Ha Choi, Anyang-si (KR); Jae Sik Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 1239 days.

(21) Appl. No.: 11/274,337

(22) Filed: Nov. 16, 2005

(65) Prior Publication Data

US 2006/0123809 A1 Jun. 15, 2006

(30) Foreign Application Priority Data

Dec. 14, 2004 (KR) ..... 10-2004-0105328

(51) Int. Cl.
*F25B 7/00* (2006.01)
*F25D 29/00* (2006.01)
*F25D 17/00* (2006.01)

(52) U.S. Cl. ..... 62/175; 62/161; 62/179

(58) Field of Classification Search ..... 62/149, 62/175, 160, 161, 178, 179, 199, 200
See application file for complete search history.

(56) References Cited

U.S. PATENT DOCUMENTS 4,926,653 A * 5/1990 Masuda et al. ..... 62/204
5,142,879 A * 9/1992 Nakamura et al. ..... 62/160
6,755,038 B2 6/2004 Hwang
6,772,600 B2 8/2004 Hwang

FOREIGN PATENT DOCUMENTS

KR 1998-049976 9/1998

OTHER PUBLICATIONS

U.S. Appl. No. 11/194,440 to Kim et al, which was filed on Aug. 2, 2005.
U.S. Appl. No. 11/281,459 to Ha et al, which was filed on Nov. 18, 2005.
English Language Abstract of KR 1998-049976.

* cited by examiner

*Primary Examiner*—Chen-Wen Jiang
(74) *Attorney, Agent, or Firm*—McKenna Long & Aldridge LLP

(57) ABSTRACT

A control method of a multi-air conditioner in which a plurality of indoor units is connected to one outdoor unit and refrigerant flow amount is adjusted by electronic expansion valves comprises a share step in which a plurality of indoor units exchanges their operation information, a comparison and judgment step in which each above indoor unit compares and judges its operation status based on the exchanged operation information, and an adjustment step in which each above indoor unit adjusts refrigerant flow amount supplied to each indoor unit based on the compared and judged operation status.

7 Claims, 7 Drawing Sheets

When performing cooling

When performing heating

When performing cooling

When performing heating

CONTROL METHOD OF AN AIR CONDITIONER INDOOR UNIT

This application claims the benefit of the Patent Korean Application No. P2004-105328, filed on Dec. 14, 2004, which is hereby incorporated by reference as if fully set forth herein.

BACKGROUND OF THE INVENTION

1. Field of the Invention

The present invention relates to an air conditioner, and more particularly, to a control method of a multi-air conditioner indoor unit.

2. Discussion of the Related Art

Generally, an air conditioner is an apparatus cooling/heating a room by the process of compressing, condensing, expanding and evaporating a refrigerant.

The air conditioner is classified into a cooling system in which a refrigerant cycle is operated only in one direction to supply cold air to the room, and a cooling/heating system in which a refrigerant cycle is selectively operated in bilateral direction to supply cold air or warm air the room.

The air conditioner is also classified into an air conditioner in which one indoor unit is connected to one outdoor unit, and a multi-air conditioner in which a plurality of indoor units is connected to one outdoor unit.

However, in conventional multi-air conditioners, each indoor unit performs sending and receiving with one outdoor unit, therein causing a problem that each indoor unit may not have the equalized capability of cooling/heating.

Even indoor units with same capacity may cause capability variation of an indoor heat exchanger, when indoor units are different models. Also although indoor units are the same models, capability variation may arise among indoor units according to the conditions in which each indoor unit is installed such as length of the pipes connected to one outdoor unit, height of the pipes, shape of the pipes branched out from one outdoor unit.

The above capability variation of each indoor unit deteriorates cooling/heating efficiency of a multi-air conditioner.

SUMMARY OF THE INVENTION

Accordingly, the present invention is directed to a control method of a multi-air conditioner indoor unit that substantially obviates one or more problems due to limitations and disadvantages of the related art.

An object of the present invention is to provide a control method of a multi-air conditioner indoor unit capable of enhancing cooling/heating efficiency by preventing capability variation among indoor units through adjusting refrigerant flow amount supplied to each indoor unit according to the capability of a plurality of indoor units connected to one outdoor unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a multi-air conditioner in which a plurality of indoor units are connected to one outdoor unit comprises a share step in which a plurality of indoor units exchanges and share its operating information; a comparison and judgment step in which each above indoor unit compares and judges its operation status based on the operation information exchanged among the indoor units; an adjustment step in which the refrigerant flow amount supplied to each above indoor unit is adjusted, according to the operation status compared and judged by the each above indoor unit.

A confirmation step is further comprised in which each above indoor unit confirms that each indoor unit receives operation information from the other indoor units.

The share step comprises a calculation step in which performance ratio of each indoor unit is calculated; and a mutual send/receive step in which each indoor unit sends/receives each performance ratio.

The above calculation step is calculated based on inlet air temperature value, outlet air temperature value, and air amount value of each indoor unit.

The comparison and judgment step distinguishes indoor units which have less than 1 performance ratio and indoor units which have more than 1 performance ratio from the indoor units.

In the comparison and judgment step, it is preferred but not necessary that the adjustment step be performed in case that there are at least one indoor unit with less than 1 performance ratio and at least one indoor unit with more than 1 performance ratio.

Thus, according to the comparison and judgment step, the indoor unit with more than 1 performance ratio is adjusted to decrease the refrigerant amount and the indoor unit with less than 1 performance ratio is adjusted to increase the refrigerant amount.

The performance ratio is the present outlet performance ratio for regular capability of the indoor unit.

In the adjustment step, the refrigerant amount supplied to each indoor unit is adjusted by a sub-electronic expansion valve provided between each indoor unit and an electronic expansion valve.

In another aspect of the present invention, a multi-air conditioner in which a plurality of indoor units is connected to one outdoor unit comprises a share step in which a plurality of indoor units sends/receives its outlet air temperature value and exchanges and shares its operating information; a comparison and judgment step in which each above indoor unit compares and judges its operation status based on the operation information exchanged among the indoor units; an adjustment step in which the refrigerant flow amount supplied to each above indoor unit is adjusted, according to the operation status compared and judged by the each above indoor unit.

The comparison and judgment step comprises a calculation step in which each indoor unit collects its outlet air temperature value to calculate average outlet air temperature value and a comparison step in which the average outlet air temperature value and the outlet air temperature value are compared In the comparison and judgment step, the adjustment step may be performed in case that there are at least one indoor unit which has lower outlet air temperature value than average outlet air temperature value and at least one indoor unit which has higher outlet air temperature value than average outlet air temperature value.

After the performance of the comparison and judgment step, the refrigerant amount supplied to the indoor unit which has lower outlet air temperature value than average outlet air temperature value is adjusted when the multi-air conditioner performs cooling. The refrigerant amount supplied to the indoor unit which has higher outlet air temperature value than average outlet air temperature value is adjusted when the multi-air conditioner performs heating.

In the adjustment step, the refrigerant amount supplied to each indoor unit is adjusted by a sub-electronic expansion valve provided between each indoor unit and each electronic expansion valve.

In another aspect of the present invention, a multi-air conditioner in which a plurality of indoor units is connected to one outdoor unit comprises a share step in which a plurality of indoor units sends/receives its each pipe temperature value and exchanges and shares its operating information; a comparison and judgment step in which each above indoor unit compares and judges its operation status based on the operation information exchanged among the indoor units; an adjustment step in which the refrigerant flow amount supplied to each above indoor unit is adjusted, according to the operation status compared and judged by the each above indoor unit.

The comparison and judgment step comprises a calculation step in which each indoor unit collects its pipe temperature value to calculate average pipe temperature value; a comparison step in which the average pipe temperature value and the pipe temperature value are compared.

In the comparison and judgment step, the adjustment step may be performed in case that there are at least one indoor unit which has lower pipe temperature value than average pipe temperature value, and a least one indoor unit which has higher pipe temperature value than average pipe temperature value.

After the performance of the comparison and judgment step, the refrigerant amount supplied to the indoor unit which has lower pipe temperature value than average pipe temperature value is adjusted when the multi-air conditioner performs cooling. The refrigerant amount supplied to the indoor unit which has higher pipe temperature value than average pipe temperature value is adjusted when the multi-air conditioner performs heating.

In the adjustment step, the refrigerant amount supplied to each indoor unit is adjusted by the sub-electronic expansion valve provided between each indoor unit and each electronic expansion valve.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
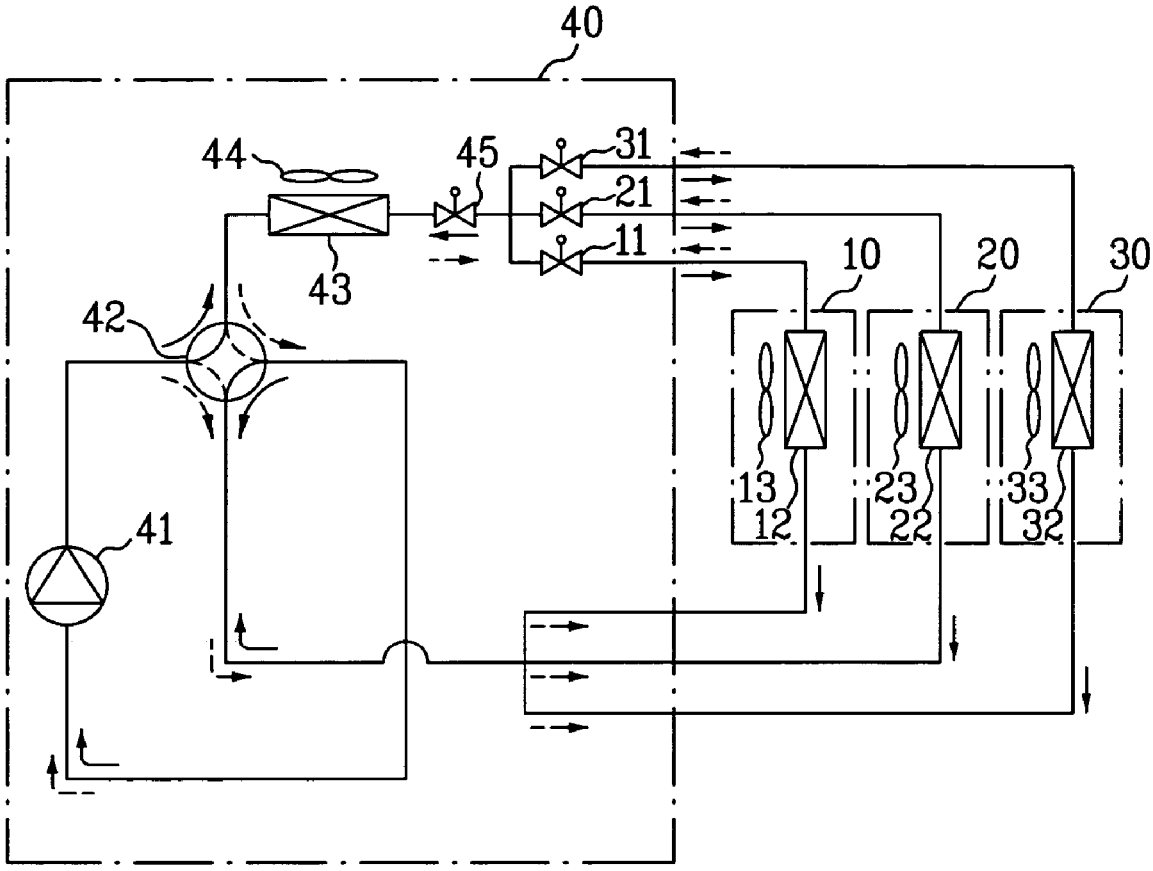
FIG. 1 is a configuration view illustrating a refrigerant cycle of a multi-air conditioner according to the present invention.

As illustrated in FIG. 1, an air conditioner according to the present invention comprises an outdoor unit and a plurality of indoor units.

Figure 2:
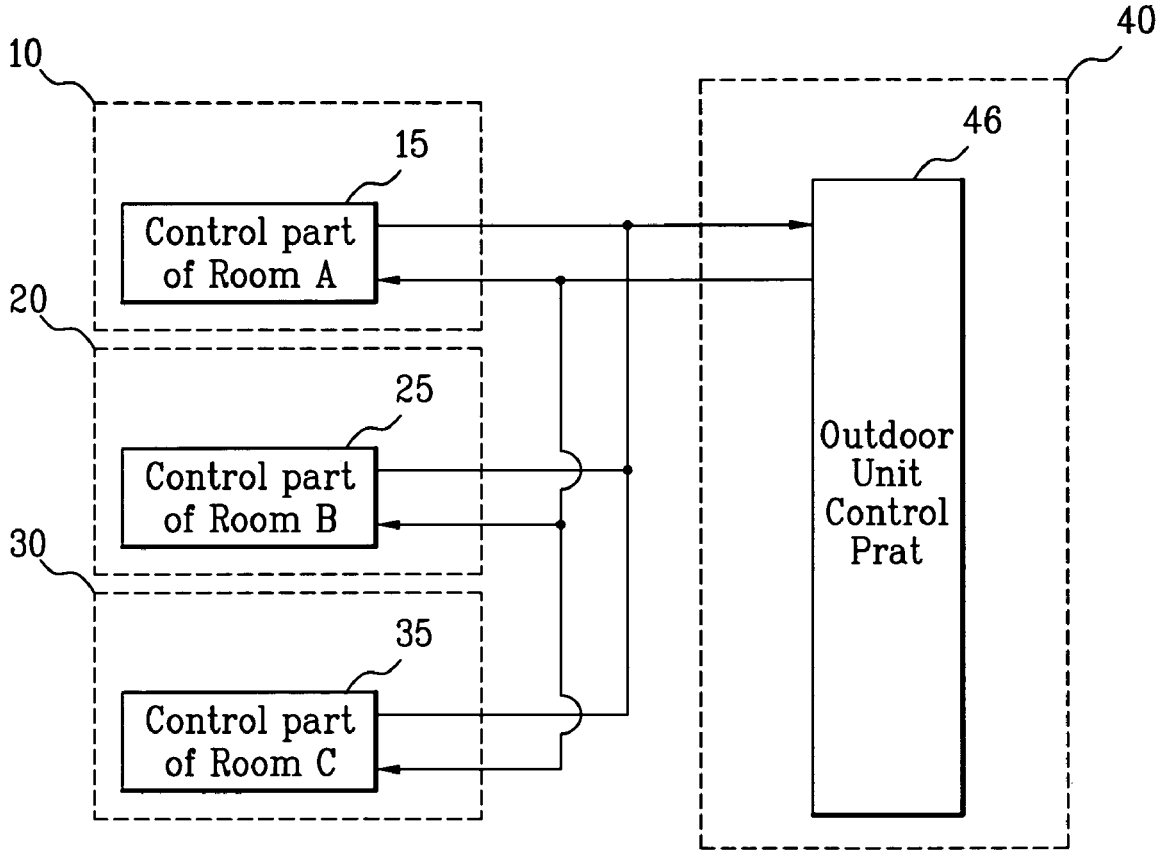
FIG. 2 is a block view illustrating a communication control apparatus of a multi-air conditioner according to the present invention.

As illustrated in FIG. 1 and FIG. 2, a multi-air conditioner according to the present invention comprises an outdoor unit 40 installed outside and a plurality of indoor units. The plurality of the indoor units comprises an indoor unit 10 in Room A, an indoor unit 20 in Room B and an indoor unit 30 in Room C.

The outdoor unit 40 comprises a compressor 41 compressing a refrigerant in the gaseous state of high temperature and high pressure, a 4-way valve 42 converting flow of the gaseous state refrigerant emitted from the compressor 41 according to operation condition such as cooling/heating, an outdoor heat exchanger 43 condensing the gas refrigerant compressed in the compressor 41 into a liquid state refrigerant of low temperature and high pressure, and an outdoor pan 44 sending the air inhaled from outside to the outdoor heat exchanger 43 in order to exchange heat without difficulty.

The outdoor unit further comprises an electronic expansion valve 45 which controls gas temperature emitted from the outdoor heat exchanger 43 to adjust overheating in heating operation and overcooling in cooling operation, and sub-electronic expansions 11, 21, 31 which adjust the refrigerant flow amount based on the condition of the indoor units 10, 20, 30, therein supplying appropriate refrigerant flow amount to each indoor unit.

The indoor units 10, 20, 30 comprise indoor heat exchangers 12, 22, 32 and indoor pans 13, 23, 33 circulating inner air to exchange air in the indoor heat exchangers 12, 22, 32 without difficulty.

Reference will now be made in detail to the operation process of the present invention, examples of which are illustrated in the accompanying drawings.

FIG. 1 is a configuration view illustrating a refrigerant cycle of a multi-air conditioner according to the present invention and while solid line arrows illustrate refrigerant flow in cooling operation, broken line arrows illustrate refrigerant flow in heating operation.

When the multi-air conditioner according to the present invention operates cooling/heating, the refrigerant compressed in high temperature in the compressor 41 flows into the outdoor heat exchanger 43. Thus the refrigerant is exchanged with outside air and condensed according to spinning of the outdoor pan 44.

The refrigerant is lead to the sub-electronic expansions 11, 21, 31 of the indoor units 10, 20, 30 after passing through the electronic expansion valve 45. The refrigerant is expanded in the sub-electronic expansion valves 11, 21, 31 and becomes a low temperature refrigerant.

The refrigerant flows into the indoor heat exchangers 12, 22, 32 and is exchanged for inside air by the indoor pans 13, 23, 33. When the indoor heat exchanger exchanges the inner air for the refrigerant, the inside air becomes a low temperature air and is emitted into inner space.

Thereafter, the above refrigerant flows into the outdoor unit and flows again into the compressor 41. With the repetitive process above described the low-temperature air is supplied to the inner space, thereby cooling the inner space.

The electronic expansion valve 45 is employed to adjust overheating based on the operation condition of each indoor unit 10, 20, 30. The sub-electronic expansion valves 11, 21, 31 of Room A, Room B, and Room C are employed to supply a refrigerant to the indoor units operated and to adjust the amount of the refrigerant flow.

As illustrated in FIG. 2, a control part of Room A 15, a control part of Room B 25, and a control part of Room C 35 provided in each indoor unit 10, 20, 30 exchange each control signal with an outdoor unit control part 46 provided in the outdoor unit 40, thereby the above operation control performed.

According to the indoor unit control method of the multi-air conditioner above mentioned, it is accomplished by the following control method of the indoor unit to supply appropriate refrigerant amount according to the operation condition of each indoor unit.

Figure 3:
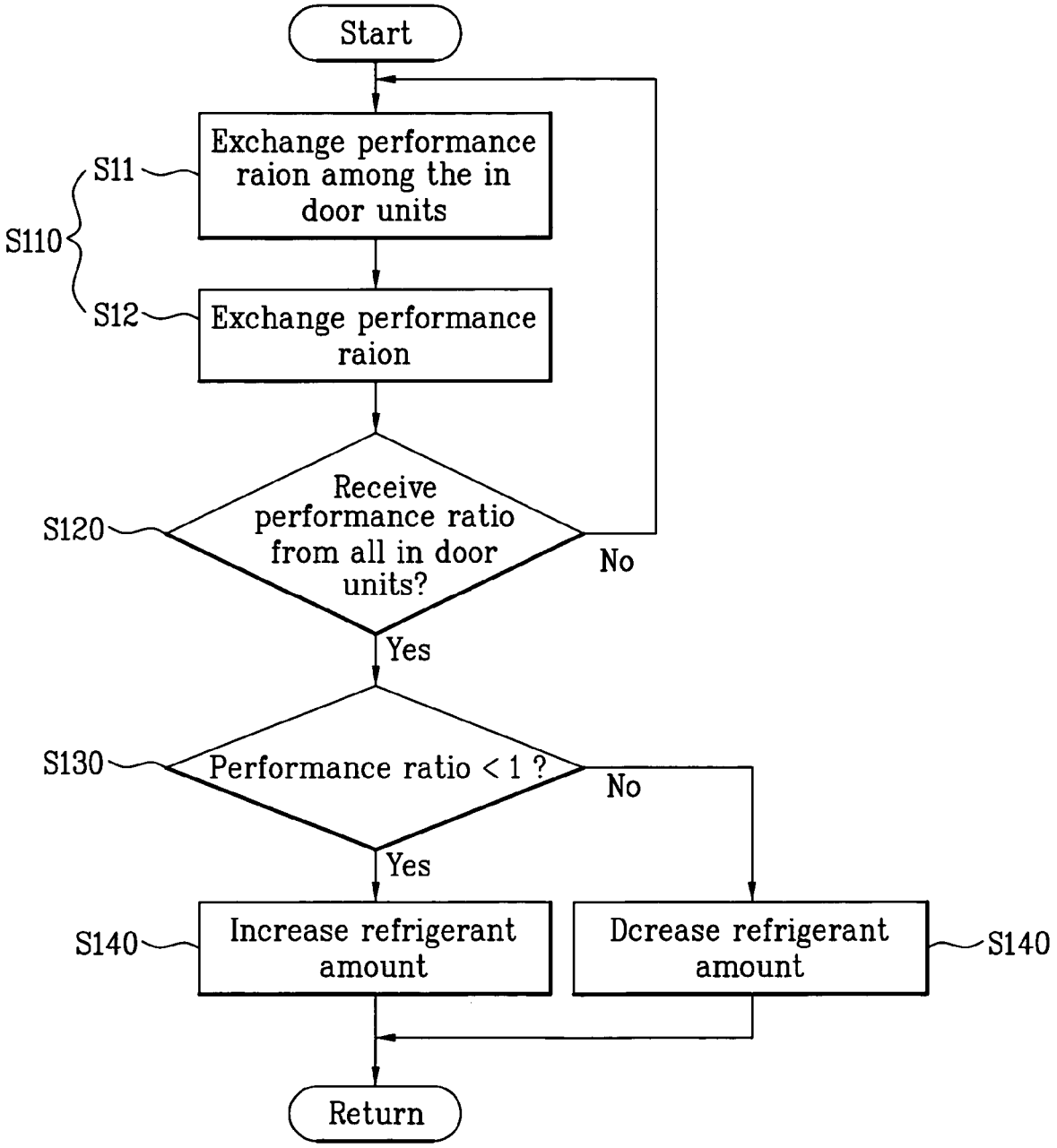
FIG. 3 is a sequence view illustrating a control method of a multi-air conditioner indoor unit according to the first embodiment of the present invention.

As illustrated in FIG. 3, a control method of a multi-air conditioner indoor unit according to the first embodiment of the present invention comprises a share step S110 in which the plurality of the indoor units shares and stores operation information among the indoor units; a confirmation step in which each indoor unit confirms that operation information is received by other indoor units; a comparison and judgment step S120 in which each indoor unit compares and judges its operation status based on the operation information exchanged among the indoor units; an adjustment step S130 in which the amount of refrigerant flow supplied to each indoor unit is adjusted, according to the operation status compared and judged by the each indoor unit.

The share step S110 comprises an exchange and storage step in which each indoor unit calculates, exchanges and stores performance ratio by its inlet air temperature value, outlet temperature value and air amount value; and a send/receive step in which each indoor unit sends/receives each performance ratio. The performance ratio is the present outlet performance ratio for regular capability of the indoor unit.

A confirmation step S120 is further comprised in which each above indoor unit confirms that each indoor unit receives operation information from the other indoor units. Each indoor unit confirms that every connected indoor unit sends each performance ratio to the other indoor units.

The comparison and judgment step S120 in which the each indoor unit compares and judges operation status of every connected indoor unit distinguishes the indoor units which have less than 1 performance ratio and indoor units which have more than 1 performance ratio from the indoor units.

In the comparison and judgment step S130, it is preferred but not necessary that the adjustment step be performed when there are at least one indoor unit with less than 1 performance ratio and at least one indoor unit with more than 1 performance ratio.

In the adjustment step S140, the indoor unit with more than 1 performance ratio adjusts the sub-electronic expansion valve to decrease refrigerant amount and the indoor unit with less than 1 performance ratio adjusts the sub-electronic valve to increase refrigerant amount, resulting in supply appropriate refrigerant amount to each indoor unit.

Figure 4A:
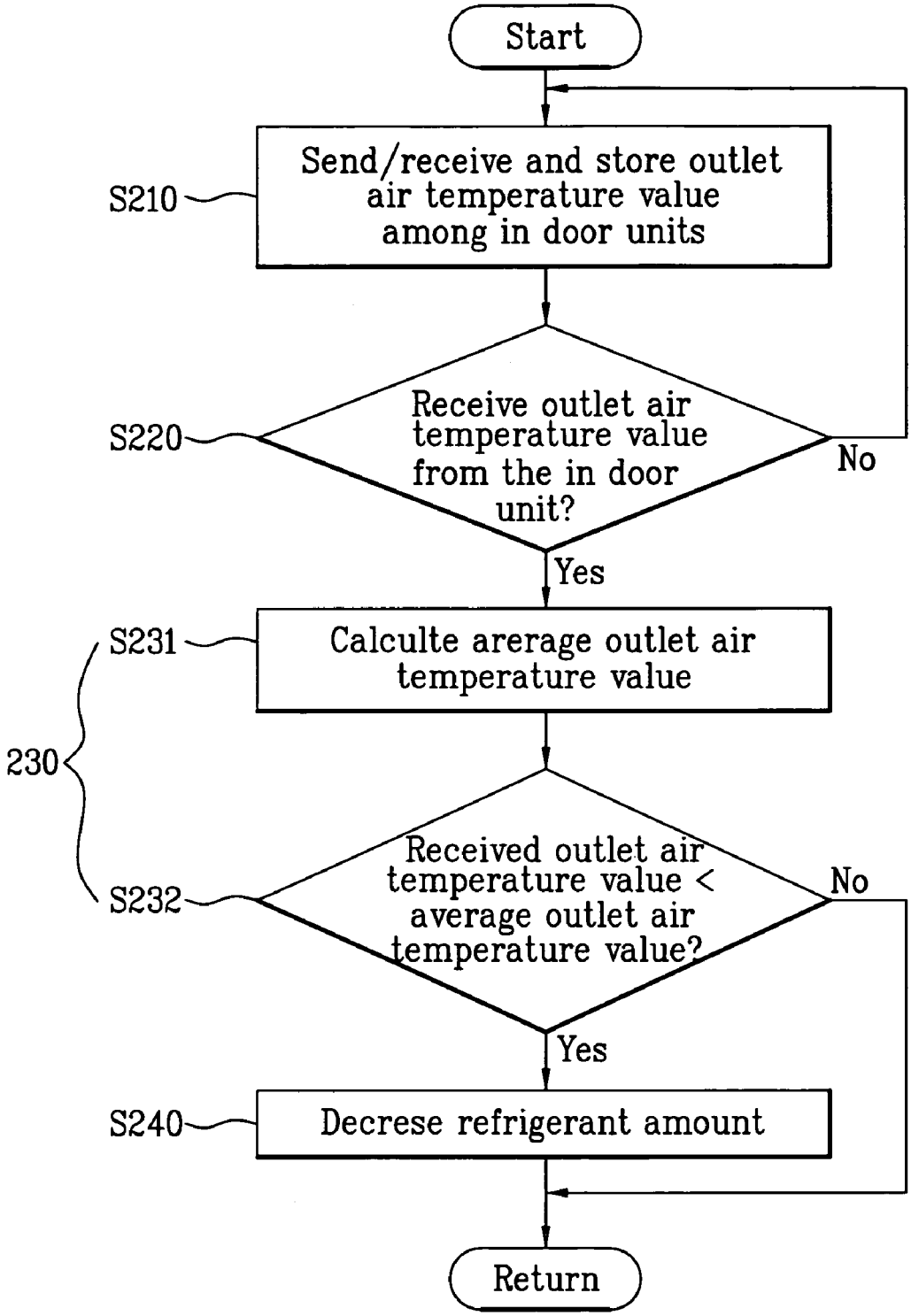
FIG. 4 is a sequence view illustrating a control method of a multi-air conditioner indoor unit according to the second embodiment of the present invention.
Figure 4B:
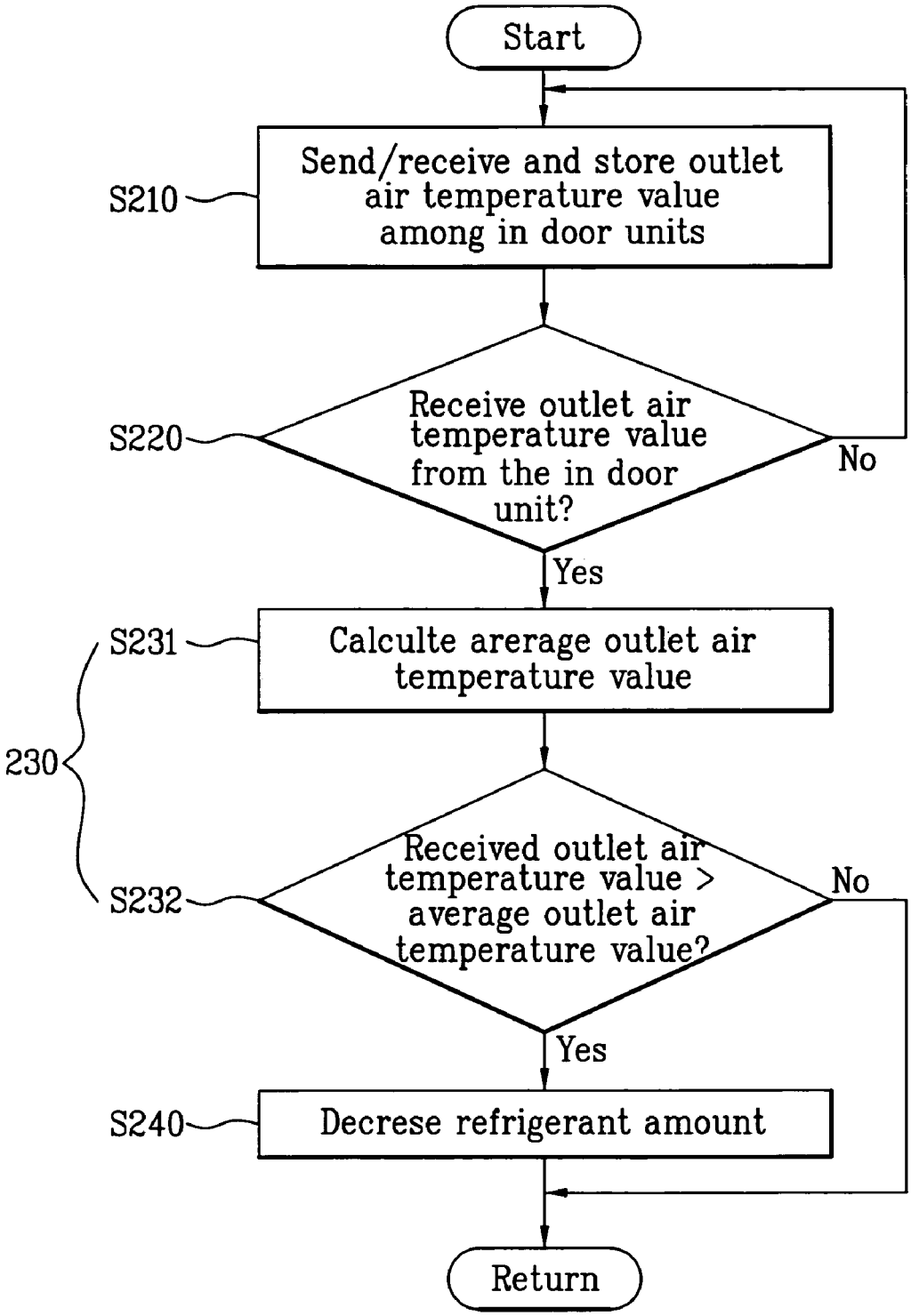

A control method of the multi-air conditioner according to the second embodiment of the present invention referring to FIG. 4*a* and FIG. 4*b* is the following.

As illustrated in FIG. 4*a* and FIG. 4*b*, a multi-air conditioner according to the second embodiment of the present invention also comprises a share step, a confirmation step, a comparison and judgment step, and an adjustment step.

However, the multi-air conditioner according to the second embodiment of the invention has different operation information which is sent/received and shared among the indoor units, so that the control method of the indoor unit comparing and judging operation status of the indoor units is different from the control method according to the first embodiment.

That is, according to the second embodiment different from the first embodiment, in the share step S210 each indoor unit sends/receives and stores each outlet air temperature value alone.

In the confirmation step S220, each indoor unit confirms that every connected indoor unit receives its outlet air temperature value.

The comparison and judgment step S230 comprises a calculation step S321 in which each indoor unit collects the outlet air temperature value of the indoor unit and calculates average outlet air temperature value and a comparison step S323 which distinguishes indoor units with lower outlet air temperature value or higher outlet air temperature value than average outlet temperature value among indoor units comparing the average outlet air temperature value with the outlet air temperature value of the each indoor unit.

In the comparison and judgment step S230, the adjustment step S240 may be performed in case that there are at least one indoor unit which has lower outlet air temperature value than average outlet air temperature value, and at least one indoor unit which has higher outlet air temperature value than average outlet air temperature value.

After the performance of the comparison and judgment step of the outlet air temperature vale, the adjustment step S240 adjusts the sub-electronic expansion valve connected to the indoor unit to decrease the refrigerant amount supplied to the indoor unit which has lower outlet air temperature value than average outlet air temperature value when the multi-air conditioner performs cooling as illustrated in FIG. 4*a*.

The adjustment step S240 adjusts the sub-electronic expansion valve connected to the indoor unit to decrease the refrigerant amount supplied to the indoor unit which has higher outlet air temperature value than average outlet air temperature value when the multi-air conditioner performs heating as illustrated in FIG. 4*b*.

Figure 5A:
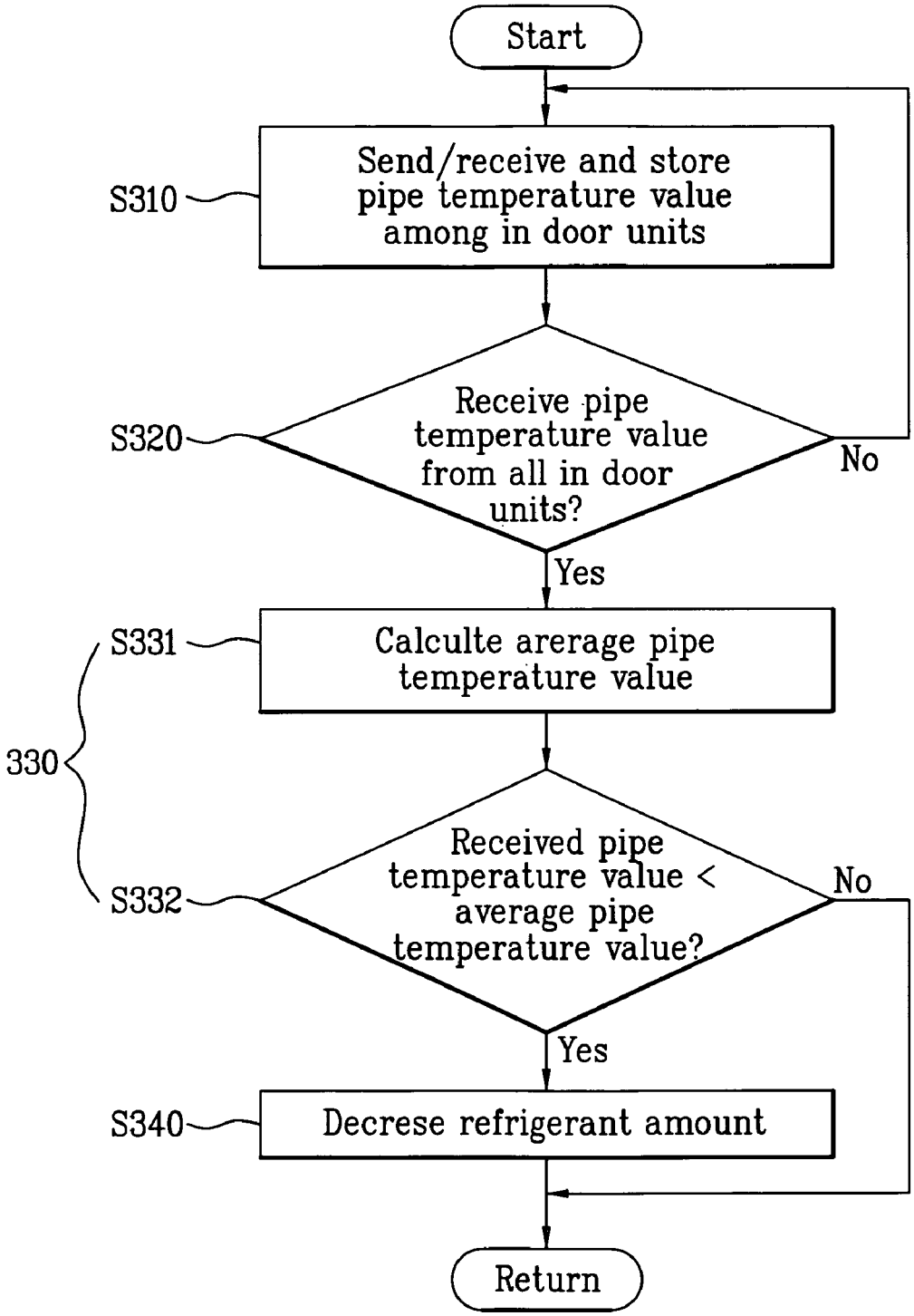
FIG. 5 is a sequence view illustrating a control method of a multi-air conditioner indoor unit according to the third embodiment of the present invention.
Figure 5B:
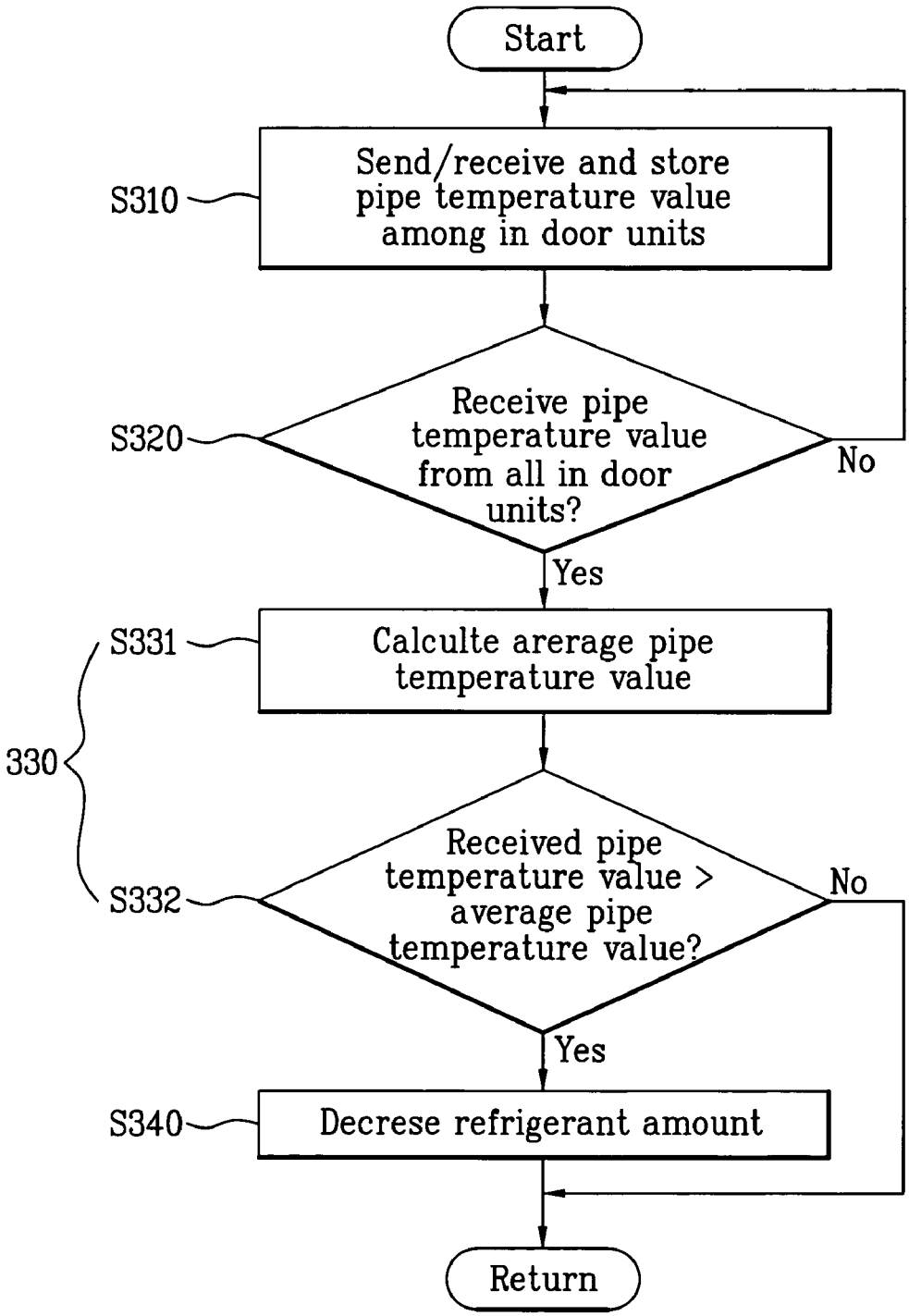

A control method of the multi-air conditioner according to the third embodiment of the present invention referring to FIG. 5*a* and FIG. 5*b* is the following.

As illustrated in FIG. 5*a* and FIG. 5*b*, a multi-air conditioner according to the third embodiment of the present invention also comprises a share step, a confirmation step, a comparison and judgment step, and an adjustment step.

However, the multi-air conditioner according to the second embodiment of the invention has different operation information which is sent/received and shared among the indoor units, so that the control method of the indoor unit comparing and judging operation status of the indoor units is different from the control method according to the first embodiment.

That is, according to the third embodiment different from the first embodiment, in the share step S310 each indoor unit sends/receives and stores each pipe temperature value alone.

In the confirmation step S320, each indoor unit confirms that every connected indoor unit receives its pipe temperature value.

The comparison and judgment step S330 comprises a calculation step S331 in which each indoor unit collects pipe temperature value of the indoor units and calculates average pipe temperature value and a comparison step S332 which distinguishes the indoor unit with lower pipe temperature value or higher pipe temperature value than average pipe temperature value among indoor units comparing the average pipe temperature value with the pipe temperature value of the each indoor unit.

In the comparison and judgment step S330, the adjustment step S340 may be performed in case that there are at least one indoor unit which has lower pipe temperature value than average pipe temperature value, and at least one indoor unit which has higher pipe temperature value than average pipe temperature value.

After the performance of the comparison and judgment step of the pipe temperature vale, the adjustment step S340 adjusts the sub-electronic expansion valve connected to the indoor unit to decrease the refrigerant amount supplied to the indoor unit which has lower pipe temperature value than average pipe temperature value when the multi-air conditioner performs cooling as illustrated in FIG. 5*a*.

The adjustment step S340 adjusts the sub-electronic expansion valve connected to the indoor unit to decrease the refrigerant amount supplied to the indoor unit which has higher pipe temperature value than average pipe temperature value when the multi-air conditioner performs heating as illustrated in FIG. 5*b*.

In the embodiments of the invention, performance ratio, outlet air temperature value and pipe temperature value are suggested as examples of operation information sent/received and shared among indoor units. Each indoor unit may be controlled by other capability variables such as inlet air temperature value.

As described above, the present invention may adjust the refrigerant amount according to the operation status of each indoor unit and prevent the unbalance of the refrigerant flow amount and the capability variation which may be caused by that a plurality of indoor units is connected to one outdoor unit, therein enhancing cooling/heating efficiency of multi-air conditioners.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control method of a multi-air conditioner indoor unit in which a plurality of indoor units are connected to one outdoor unit, comprising:

a share step in which the plurality of indoor units exchanges operation information;

a comparison and judgment step in which each indoor unit compares and judges its operation status based on the exchanged operation information; and an adjustment step in which each indoor unit adjusts a refrigerant flow amount supplied to each indoor unit based on the compared and judged operation status, wherein the share step comprises a calculation step in which each indoor unit calculates a performance ratio of each indoor unit, and a send/receive step in which each indoor unit sends/receives its performance ratio, wherein the performance ratio is the present outlet performance ratio for regular capability of the indoor unit.

2. The control method of a multi-air conditioner indoor unit of claim 1, further comprising: after the share step, a confirmation step in which each above indoor unit confirms that each indoor unit receives operation information from the other indoor units.

3. The control method of a multi-air conditioner indoor unit of claim 1, wherein the performance ratio is calculated by inlet air temperature value, outlet air temperature value, and air amount of each indoor unit.

4. The control method of a multi-air conditioner indoor unit of claim 1, wherein the comparison and judgment step distinguishes the indoor units which have less than 1 performance ratio and the indoor units which have more than 1 performance ratio from the indoor units.

5. The control method of a multi-air conditioner indoor unit of claim 1, wherein in the comparison and judgment step, an adjustment step is performed in case that there are at least one indoor unit with less than 1 performance ratio and at least one indoor unit with more than 1 performance ratio.

6. The control method of a multi-air conditioner indoor unit of claim 5, wherein, according to the comparison and judgment step, the indoor unit with more than 1 performance ratio is adjusted to decrease the refrigerant amount and the indoor unit with less than 1 performance ratio is adjusted to increase the refrigerant amount.

7. The control method of a multi-air conditioner indoor unit of claim 1, wherein in the adjustment step, the refrigerant amount supplied to each indoor unit is adjusted by a sub-electronic expansion valve provided between each indoor unit and electronic expansion valve.

* * * * *